US008307476B1

(12) United States Patent
Weaver et al.

(10) Patent No.: US 8,307,476 B1
(45) Date of Patent: Nov. 13, 2012

(54) BEACH TOWEL WITH BUILT-IN PILLOW

(76) Inventors: Christopher Cline Weaver, Pottsboro, TX (US); Suzanne Weaver, Pottsboro, TX (US)

( * ) Notice: Subject to any disclaimer, the term of this patent is extended or adjusted under 35 U.S.C. 154(b) by 0 days.

(21) Appl. No.: 12/931,332

(22) Filed: Jan. 27, 2011

Related U.S. Application Data

(63) Continuation-in-part of application No. 29/349,541, filed on Apr. 12, 2010, now Pat. No. Des. 639,597.

(51) Int. Cl.
*A47G 9/06* (2006.01)

(52) U.S. Cl. ..... 5/417; 5/419; 5/656; 5/490

(58) Field of Classification Search ..... 5/417–420, 5/484, 485, 490, 656
See application file for complete search history.

(56) References Cited

U.S. PATENT DOCUMENTS 2,264,471 A * 12/1941 Glenn ..... 5/419
2,870,464 A * 1/1959 Lalick ..... 5/484
3,148,388 A * 9/1964 Espersen ..... 5/485
3,689,947 A * 9/1972 Wolf ..... 5/419
4,200,942 A * 5/1980 Case ..... 5/655.3
4,278,719 A * 7/1981 Sarnecki ..... 428/78
5,467,487 A * 11/1995 Sicard ..... 5/419
5,729,846 A * 3/1998 Sullivan ..... 5/419
5,774,912 A * 7/1998 Dominique ..... 5/419
5,966,757 A * 10/1999 Sullivan ..... 5/417
7,516,500 B2 * 4/2009 Akkad ..... 5/419

* cited by examiner

*Primary Examiner* — Michael Trettel
(74) *Attorney, Agent, or Firm* — Risto A. Rinne, Jr.

(57) ABSTRACT

An apparatus for placement on the ground includes a pouch with a removable pillow that is preferably made of a memory foam type of material. A top sheet is formed of a desired flexible fabric material for comfort. The top sheet is extended to form the pouch. A preferred material for the top sheet includes a cotton cloth or cotton blend of fabric. A water resistant bottom sheet is optionally disposed or laminated under the top sheet and is used to keep the top sheet dry when the apparatus is placed on a damp surface. A plastic film or any flexible material resistant to the passage of moisture can be used as the bottom sheet. An extension sheet portion is optionally provided that can be extended along the plane of the ground surface beyond the pillow to provide additional ground cover for the placement of objects, thereon, which keeps the objects dry and away from sand or dirt The use of buttons is preferred for closure of the pouch, closure of the apparatus into a folded state for transport, and for attachment of an optional detachable carrying strap.

10 Claims, 6 Drawing Sheets

BEACH TOWEL WITH BUILT-IN PILLOW

This patent application is a continuation in part of currently design patent application Ser. No. 29/349,541, now U.S. Pat. No. D639,597 that was filed on Apr. 12, 2010 by the same inventors, and which claims the date of priority, thereof.

BACKGROUND OF THE INVENTION

1. Field of the Invention

The present invention, in general, relates to towels and blankets, more particularly, to beach towels.

Most medical professionals will agree that during periods of sleep or when laying in a horizontal position, proper head and neck support is important in the prevention of back and or neck pain that can lead to a condition which requires medical attention.

Many people have adequate head and neck support in their homes most commonly in the form of a pillow used in concert with a bed or a sofa. When away from home such as during a vacation or day outing, a beach towel is the most common choice for utilization as a temporary ground cover when at a beach or a park.

Items used as a substitute for a pillow such as jackets, additional towels, and so forth produce results that do not provide optimum head and neck support.

Although beach towels that include a pillow are known, they have certain deficits. For example, certain prior art beach towels with pillows use pillows made of cotton fibers, open-cell foam, actual feathers, or feather-like materials that can provide a haven for mites, no-see-ums, and other organisms. Also prior art pillows do not provide adequate support at opposite ends of the pillow. This requires a user to place their head near the center of the pillow which limits usage to only one person. If two or more people try to use a prior art design some will need to rest their heads near the opposite ends which provide very little support, making the users feel uncomfortable.

Also prior art pillows can absorb moisture from the sand and they also tend to accumulate sand or dirt which can be very difficult to remove. The moisture and dirt can cause mold to form in the pillow. Even if a prior art pillow is removed the moisture inside the pillow cannot be readily extracted which promotes mold, mildew, and micro-organism growth.

Additionally, prior art designs are limited in size. There is a need for a larger beach towel with a built-in pillow that can accommodate three or more users at the same time. There is also a need to more quickly be able to remove a pillow from a prior art type of beach towel for drying or general cleaning.

Accordingly, there exists today a need for a beach towel with built-in pillow that helps to ameliorate the above-mentioned problems and difficulties as well as ameliorate those additional problems and difficulties as may be recited in the "OBJECTS AND SUMMARY OF THE INVENTION" or discussed elsewhere in the specification or which may otherwise exist or occur and that are not specifically mentioned herein.

As various embodiments of the instant invention help provide a more elegant solution to the various problems and difficulties as mentioned herein, or which may otherwise exist or occur and are not specifically mentioned herein, and by a showing that a similar benefit is not available by mere reliance upon the teachings of relevant prior art, the instant invention attests to its novelty. Therefore, by helping to provide a more elegant solution to various needs, some of which may be long-standing in nature, the instant invention further attests that the elements thereof, in combination as claimed, cannot be obvious in light of the teachings of the prior art to a person of ordinary skill and creativity.

Clearly, a beach towel with a built-in pillow which provides the aforementioned benefits would be useful and desirable.

2. Description of Prior Art

Beach towels with a built-in pillow, in general, are known. For example, the following patent documents describe various types of these devices, some of which may have some degree of relevance to the invention. Other patent documents listed below may not have any significant relevance to the invention. The inclusion of these patent documents is not an admission that their teachings anticipate any aspect of the invention. Rather, their inclusion is intended to present broad and diversified understanding regarding the current state of the art appertaining to either the field of the invention or possibly to other related or even distal fields of invention.

U.S. Pat. No. 7,513,001 to Leach, that issued on Apr. 7, 2009;

U.S. Pat. No. 6,721,973 to Cristiano, that issued on Apr. 20, 2004;

U.S. Pat. No. 5,987,667 to Haverly et al., that issued on Nov. 23, 1999;

U.S. Pat. No. 5,729,846 to Sullivan, that issued on Mar. 24, 1998;

U.S. Pat. No. 5,644,807 to Battistella, that issued on Jul. 8, 1997;

U.S. Pat. No. 5,629,071 to Feldman, that issued on May 13, 1997;

U.S. Pat. No. 5,457,829 to Elliott, that issued on Oct. 17, 1995;

U.S. Pat. No. 5,361,435 to Reeves, that issued on Nov. 8, 1994;

U.S. Pat. No. 5,199,120 to Holmes, that issued on Apr. 6, 1993;

U.S. Pat. No. 5,099,530 to Scott, that issued on Mar. 31, 1992;

U.S. Pat. No. 4,980,935 to Kazanowski et al., that issued on Jan. 1, 1991;

U.S. Pat. No. 4,546,507 to Weinstein, that issued on Oct. 15, 1985;

U.S. Pat. No. 4,231,125 to Tittl, that issued on Nov. 4, 1980;

U.S. Pat. No. 4,014,055 to Torres, that issued on Mar. 29, 1977;

U.S. Pat. No. 2,420,344 to Alexander, that issued on May 13, 1947;

U.S. Pat. No. 2,183,418 to Williams, that issued on Dec. 12, 1939;

U.S. Pat. No. 2,038,335 to Aronow, that issued on Apr. 21, 1936; and

U.S. Pat. No. 1,925,358 to Wittcoff, that issued on Sep. 5, 1933.

And including U.S. Design patents:

U.S. Design Pat. No. D580,694 to Horne, that issued on Nov. 18, 2008;

U.S. Design Pat. No. D392,146 to Gregg, that issued on Mar. 17, 1998;

U.S. Design Pat. No. D383,634 to Selph, that issued on Sep. 16, 1997;

U.S. Design Pat. No. D341,979 to Peters, that issued on Dec. 7, 1993;

U.S. Design Pat. No. D341,513 to Reeves, et al., that issued on Nov. 23, 1993; and U.S. Design Pat. No. D258,035 to Fenwick, that issued on Jan. 27, 1981.

And including U.S. Patent Application Publications:

U.S. Patent Application Publication No. 2009/0077746 to Wilson, that published on Mar. 26, 2009; and U.S. Patent Application Publication No. 2005/0262634 to Gottlieb, that published on Dec. 1, 2005.

While the structural arrangements of the above described devices may, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a beach towel with built-in pillow that can resist the accumulation of sand or dirt.

It is an important object of the invention to provide a beach towel with built-in pillow that does not allow infestation of no-see-ums.

Another object of the invention is to provide a beach towel with built-in pillow that includes a pillow that is readily removable from a pocket.

Still another object of the invention is to provide a beach towel with built-in pillow that includes a pillow that provides improved support for a head of a user.

Still yet another object of the invention is to provide a beach towel with built-in pillow and that provides improved support for a head of a user extending from one end of the pillow to an opposite end of the pillow.

A first continuing object of the invention is to provide a beach towel with built-in pillow that can be folded and secured with button fasteners to allow for rapid opening from a closed position for use.

A second continuing object of the invention is to provide a beach towel with built-in pillow that includes a pillow that can include a memory type of foam.

A third continuing object of the invention is to provide a beach towel with built-in pillow that can include a carrying strap which is disposed at a foot-end of the towel.

A fourth continuing object of the invention is to provide a beach towel with built-in pillow that includes an extension sheet to protect the underside of the pillow from moisture.

A fifth continuing object of the invention is to provide a beach towel with built-in pillow that includes an extension sheet which can be extended in front of the pillow in order to provide additional ground cover or protection from sand accumulation.

A sixth continuing object of the invention is to provide a beach towel with built-in pillow that includes a bottom sheet with water-proof characteristics laminated to a top sheet which is preferably made from terry cloth or similar material.

A seventh continuing object of the invention is to provide a beach towel with built-in pillow that has a pillow which extends the full width of the towel.

An eighth continuing object of the invention is to provide a beach towel with built-in pillow that is available in various sizes preferably up to seventy two inches in width by ninety inches in length to accommodate use of the invention by a whole family or by multiple users.

A ninth continuing object of the invention is to provide a beach towel with built-in pillow that includes a pillow formed of a closed-cell type foam.

A tenth continuing object of the invention is to provide a beach towel with built-in pillow that is resistant to an accumulation of mold.

An eleventh continuing object of the invention to provide a beach towel with built-in pillow that is resistant to an accumulation of mildew.

A twelfth continuing object of the invention is to provide a beach towel with built-in pillow that is resistant to an accumulation of micro-organisms.

A thirteenth continuing object of the invention is to provide a beach towel with built-in pillow that is resistant to an accumulation of moisture.

A fourteenth continuing object of the invention is to provide a beach towel with built-in pillow that includes a pillow which does not absorb moisture.

A fifteenth continuing object of the invention is to provide a beach towel with built-in pillow that includes a pillow which deters infiltration by mites.

A sixteenth object of the invention is to provide a beach towel with built-in pillow that includes the use of buttons to secure a pillow in a built-in pocket.

A seventeenth object of the invention is to provide a beach towel with built-in pillow that can include a carrying strap which is attached to the towel near a foot portion of the towel.

An eighteenth object of the invention is to provide a beach towel with built-in pillow that can include a carrying strap which is detachable.

A nineteenth object of the invention is to provide a beach towel with built-in pillow that can be folded up and secured for transport in a short period of time.

A twentieth object of the invention is to provide a beach towel with built-in pillow that can be unfolded for use in a short period of time.

A twenty-first object of the invention is to provide a beach towel with a built-in pillow that includes buttons for securement in a folded orientation for transport.

A twenty-second object of the invention is to provide a beach towel with built-in pillow that can be folded up into a closed positidn for transport and when the beach towel with built-in pillow is disposed and secured in the closed position it can be used as a traveling pillow.

A twenty-third object of the invention is to provide a beach towel with built-in pillow that can be used as a baby changing station.

Briefly, a beach towel with built-in pillow that is constructed in accordance with the principles of the present invention has a rectangular shaped towel which includes a pouch sewn into an end portion of the towel that contains a pillow preferably made from a memory foam material. The pillow can be removed from the pouch, cleaned and replaced back into the pouch section of the beach towel with built-in pillow. The beach towel with built-in pillow preferably includes an extension sheet that is sewn onto the same end of the towel where the pillow is located. The extension sheet can be folded under the pillow to protect against moisture or extended in front of the pillow to provide an additional ground cover area that provides protection from sand entry. The beach towel with built-in pillow is able to be folded lengthwise into a closed position and maintained in the closed position by a pair of buttons or equivalent means. The beach towel with built-in pillow is able to used as a traveling pillow when disposed in the closed position. A carrying strap is optionally included that is attached to an end of the towel opposite the pillow. The carrying strap is easily accessed after the beach towel with built-in pillow is folded and secured for transport. The beach towel with built-in pillow can also be used on any desired flat surface to provide a baby changing station.

DETAILED DESCRIPTION OF THE INVENTION

Figure 1:
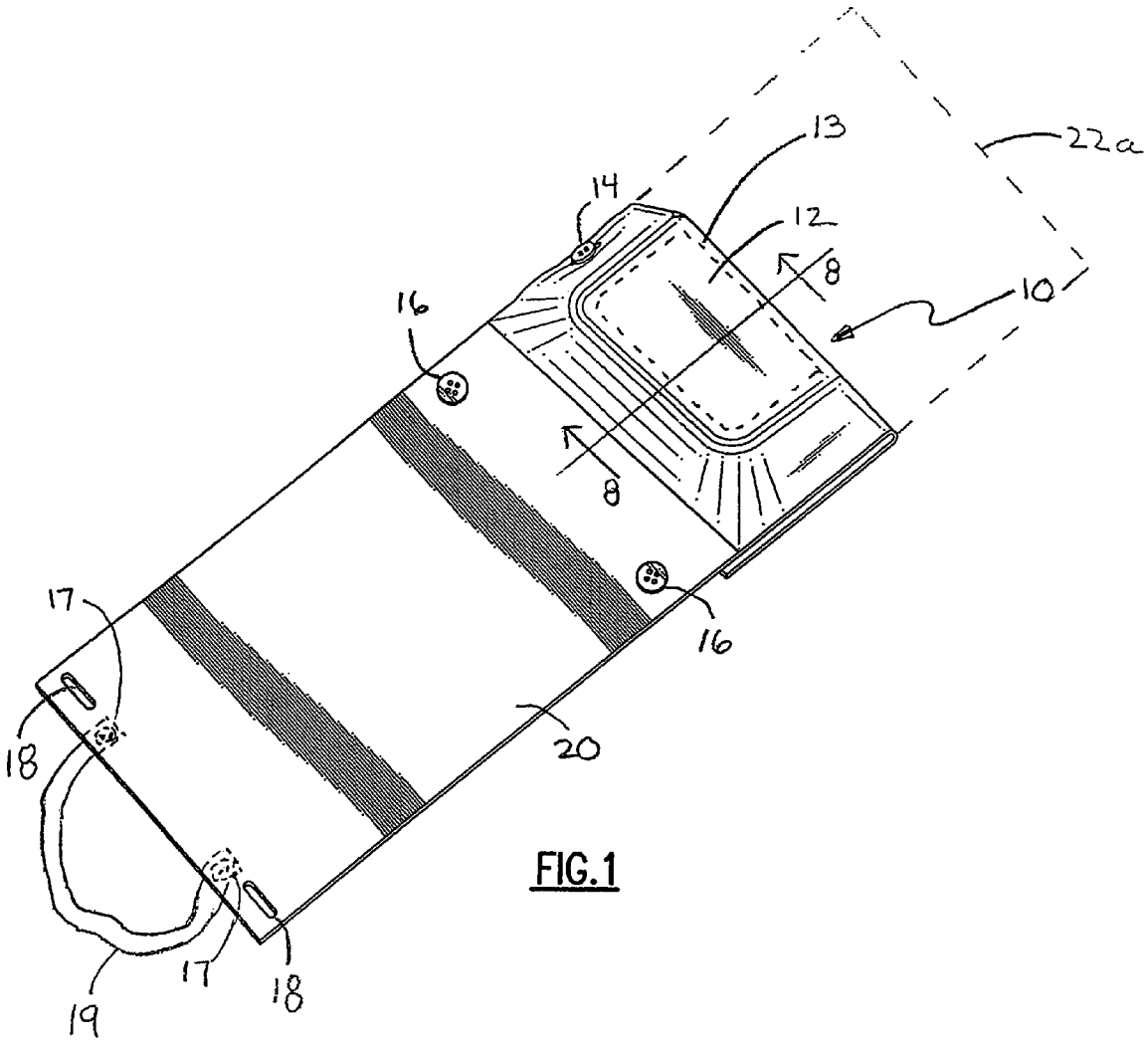
FIG. 1 is a view in perspective of a beach towel with built-in pillow.

Referring on occasion to all of the FIGURE drawings and now, in particular to FIG. 1, is shown a beach towel with built-in pillow, identified in general, by the reference numeral 10.

The reader will notice that reference is occasionally made throughout the DETAILED DESCRIPTION OF THE INVENTION suggesting that the reader refer to a particular drawing FIGURE. The suggestion is at times made when the introduction of a new element requires the reader to refer to a different drawing FIGURE than the one currently being viewed and also when the timely viewing of another drawing FIGURE is believed to significantly improve ease of reading or enhance understanding. To promote rapid understanding of the instant invention the reader is encouraged to periodically refer to and review each of the drawing FIGURES for possible cross-referencing of component parts and for other potentially useful information.

The beach towel with built-in pillow 10 is for use in any situation where a pillow and a towel would be used in concert with each other. Applicable uses for the beach towel with built-in pillow 10 include all manner of recreational uses, and outdoor events. For example, the beach towel with built-in pillow 10 could be used at the beach or at a picnic or backyard barbeque. Preferably, the beach towel with built-in pillow 10 is available in different sizes from small child-size, medium size, up to a large family size. A preferred dimension for the large family size version is seventy-two inches in width by ninety inches in length.

The beach towel with built-in pillow 10 includes a pouch 12, which extends the full width of the beach towel with built-in pillow 10. The pouch 12 includes a pouch button fastener 14 at one end thereof to allow easy access and removal and replacement of a pillow 13, shown in dashed lines. The aforementioned features allow the pillow 13 to be removed from the pouch 12 to remove any sand or dirt that may have entered into the pouch 12 or for drying if the beach towel with built-in pillow 10 should become wet.

The pillow 13 is preferably (i.e., optionally) made of memory foam to provide anti-microbial protection from mites and no-see-ums in addition to improving comfort. Other materials may also be used for the pillow 13. The pouch button fastener 14 can be substituted with a hook and loop fastener such as VELCRO™ or a zipper to retain the pillow 13 within the pouch 12 if desired.

The beach towel with built-in pillow 10 is preferably equipped with a pair of towel button fasteners 16 located below the pouch 12 on opposite sides of the beach towel 10. A pair of towel button holes 18 are preferably provided (sewn) onto a lower portion of the beach towel 10. Preferably, the pair of towel button holes 18 will be located a few inches from the end of a top sheet 20, which will be described in greater detail hereinafter.

Figure 7:
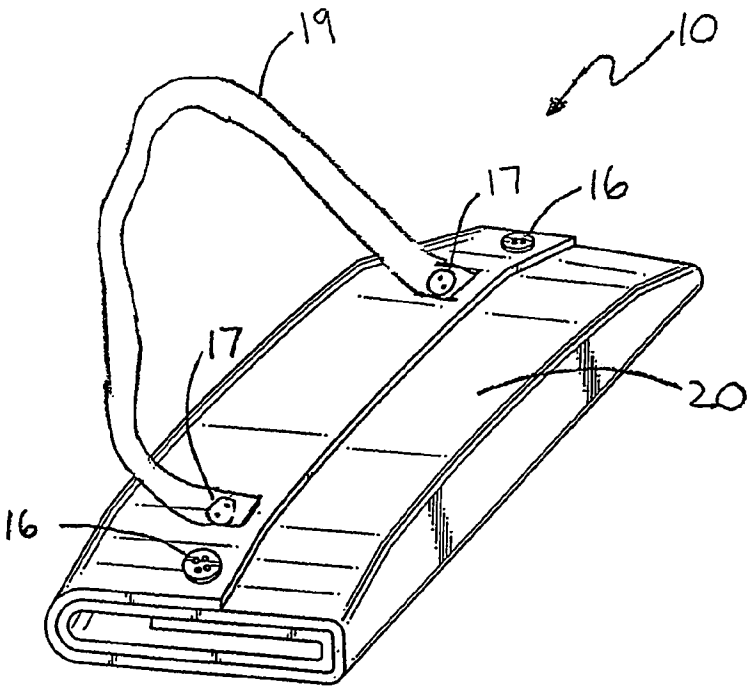
FIG. 7 is a view in perspective of the beach towel with built-in pillow of FIG. 1 shown in a folded orientation.

The towel button holes 18 penetrate the top sheet 20 and a bottom sheet 24 (See FIGS. 2, 4 & 5) to allow complete insertion of the button fasteners 16. The bottom sheet 24 is optional and, when included, its structure and use are described in greater detail hereinafter. The towel button fasteners 16 are inserted through the towel button holes 18 after the beach towel with a built-in pillow 10 has been folded in preparation for transport or storage as shown in FIG. 7 into a closed position.

A carrying strap 19 is optionally attached onto an end of the beach towel 10 opposite to where the pouch 12 and pillow 13 are disposed. A pair of strap button holes 25 (See FIG. 2) are located at each opposite end of the carrying strap 19. A pair of strap button fasteners 17 adjacent to each towel button hole 18 are preferably used to attach the carrying strap 19 to the beach towel 10. The carrying strap 19, if included, can be attached in any preferred way such as by sewing, VELCRO™, or any other manner. The carrying strap 19 is preferably of a length that would allow options for grasping the carrying strap 19 by a hand or slung over a shoulder for transport. A preferred material for the carrying strap 19 is a canvas type cloth although any preferred material could be used.

Figure 2:
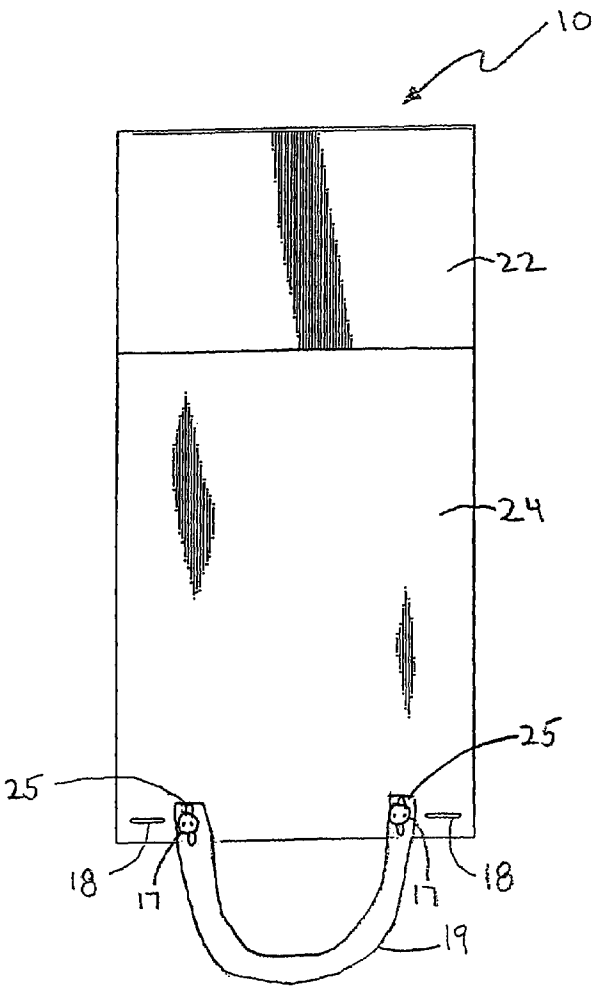
FIG. 2 is a plan view of an underside of the beach towel with built-in pillow of FIG. 1.

The beach towel with built-in pillow 10 is preferably comprised of the top sheet 20 that is preferably made of a terry cloth, cotton cloth, cotton blend, or similar material suitable for absorbing excess moisture and providing comfort when a person is lying on the top sheet 20. The bottom sheet 24, shown in FIG. 2, is preferably made of a material similar to a plastic film that can easily shed sand and protect against moisture penetrating the top sheet 20 of the beach towel 10. If desired, the bottom sheet 24 can be eliminated.

Referring again to FIG. 2, a bottom view of the beach towel with built-in pillow 10 is shown in an unfolded orientation. The beach towel with built-in pillow 10 is comprised of the bottom sheet 24, that is able to repel moisture and suitable for use on bare ground or sand.

An extension sheet 22 is preferably (i.e., optionally) attached to the top edge of the pouch 12 opposite from the bottom edge of the pouch 12 that is attached to the top sheet 20 and bottom sheet 24. If desired, a different material can be used for the extension sheet 22 in which case an edge of the extension sheet 22 would be attached to the beach towel with built-in pillow 10 by any preferred method.

The extension sheet 22 can be, if desired, disposed under the pouch 12 when additional protection from the sand or ground objects is not desired. Alternately the extension sheet 22 can be extended outward away from the pillow 13 as shown by dashed line **22*a* of FIG. 1. This provides an additional area for storing items above the sand or ground surface. A preferred material for the extension sheet 22** is a waterproof, flexible type plastic film that is able to withstand minor scrapes associated with using a material as a ground cover.

Any type of flexible material that is resistant to the passage of moisture is possible for use as the extension sheet 22. However, when the extension sheet 22 is included it does not necessarily have to include (i.e., be made of) a material that resists the passage of moisture. Therefore, any preferred type of flexible material can be used for the extension sheet 22 including terry cloth, cotton fabric, or a cotton blend type of fabric as well as other synthetic materials. If desired, the extension sheet 22 can include a layered or laminated structure similar to that which is possible for the top sheet 20 and bottom sheet 24. In this instance the extension sheet 22 would include a flexible fabric material on top (for the placement of objects, thereon) and a more water resistant flexible material (any preferred type) underneath. The upper flexible fabric material and the lower more water resistant flexible material can be attached relative to each at the perimeter thereof by sewing or adhesive (or other means) or, if desired, they can be laminated together by any preferred means. The top sheet 20 and the bottom sheet 24 can be similarly secured to one-another.

Figure 3:
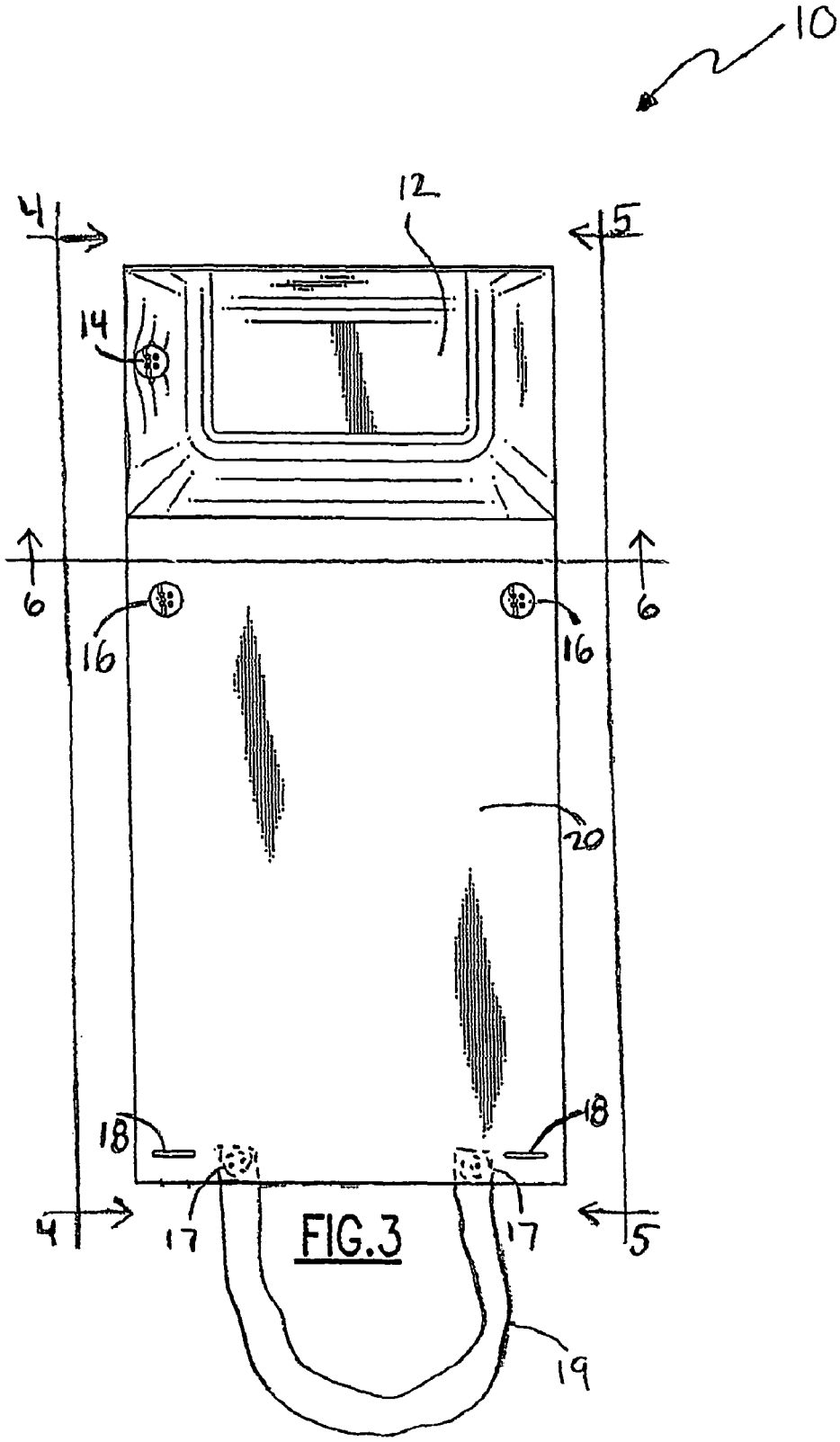
FIG. 3 is a top view of the beach towel with built-in pillow of FIG. 1.

Referring to FIG. 3, a top view of the beach towel with built-in pillow 10 is shown in an unfolded orientation exposing the top sheet 20 and the pouch 12 that contains the pillow 13, which is held inside the pouch 12 by the pouch button fastener 14. Also shown is the orientation of the pair of towel button fasteners 16 and the corresponding pair of towel button holes 18 for securing the beach towel with built-in pillow 10 in a folded state as shown in FIG. 7.

Figure 4:
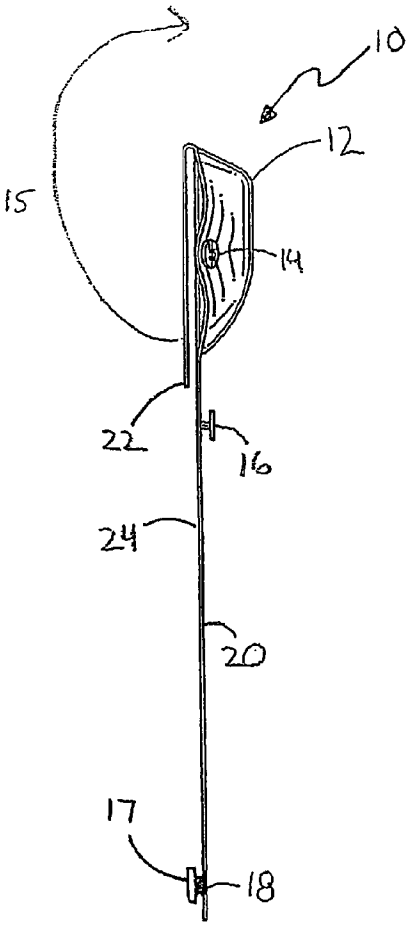
FIG. 4 is a side view of the beach towel with built-in pillow taken along the lines 4-4 in FIG. 3.

A side view of the beach towel with built-in pillow 10 is shown in FIG. 4 taken along the lines 4-4 in FIG. 3, which identifies the location of the pouch button fastener 14 in relation to the location of the pouch 12. The extension sheet 22 is shown disposed under the pouch 12. The extension sheet 22 can preferably be unfolded in the direction of arrow 15 in order to provide additional ground cover.

Figure 5:
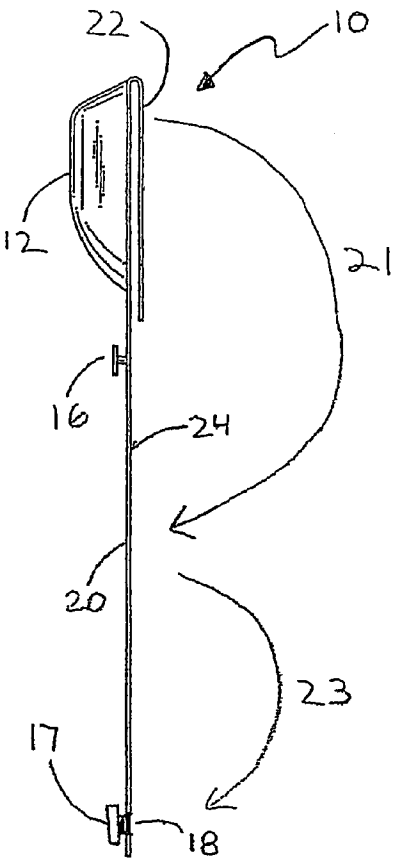
FIG. 5 is a side view of the beach towel with built-in pillow taken along the lines 5-5 in FIG. 3.

An opposite side view of the beach towel with built-in pillow 10 is shown in FIG. 5 taken along the lines 5-5 in FIG. 3, which shows the closed end of the pouch 12. Folding of the beach towel with built-in pillow 10 is preferably accomplished by folding the pouch 12 in the direction of arrow 21, and then folding again in the direction of arrow 23. Depending on the overall length of the beach towel with built-in pillow 10, an additional folding sequence may be required to complete the folding process. When properly folded, the towel button fasteners 16 will align with the towel button holes 18 after the last fold. The towel button fasteners 16 are inserted through the towel button holes 18 in order to prevent unintentional unfolding during transport and storage. The carrying strap 19, as shown in FIG. 1, is preferably attached to the strap button fasteners 17 using the strap button holes 25 located at each opposite end of the carrying strap 19.

Figure 6:
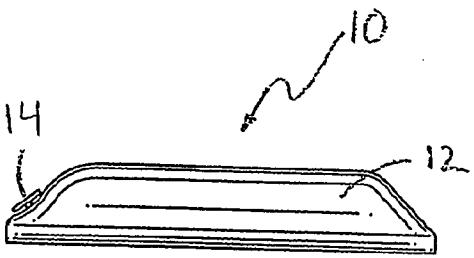
FIG. 6 is a side view of the beach towel with built-in pillow taken along the lines 6-6 in FIG. 3.

A back view of the beach towel with built-in pillow 10 is shown in FIG. 6 taken along the lines 6-6 in FIG. 3, which illustrates how the pouch 12 has an open end that is preferably secured with the pouch button fastener 14. Other possible methods of closure for the pouch 12 include a zipper or VELCRO™ or snap closure.

Referring to FIG. 7, the beach towel with built-in pillow 10 is shown in a preferred folded orientation (i.e., a closed position). The towel button fasteners 16 retain the folded orientation when used in conjunction with the towel button holes 18. When the beach towel with built in pillow 10 is disposed in the closed position it functions as a large travelling pillow. Ease of transport is provided by the carrying strap 19, if included, which is of a length that allows the beach towel with built-in pillow 10 to be slung over a shoulder or carried by a hand.

The carrying strap 19 is shown in FIG. 1 and FIG. 7 at the preferred location disposed at the end of the beach towel 10 that is opposite where the pillow 13 is disposed. This position for the carrying strap 19 ensures the carrying strap 19 will not be disposed above or below the pillow 13. If the carrying strap 19 was disposed above or below the pillow 13, its presence could adversely affect comfort when a user placed his or her head over the pillow 13. Also, the carrying strap 19 is apt to get dirty. By disposing the carrying strap 19 maximally away from the pillow 13, the user is made more comfortable and dirt that accumulates on the carrying strap 19 is prevented from being deposited on the pouch 12 over the pillow 13. If the carrying strap 19 is secured to the top sheet 20 with the strap button fasteners 17, then the carrying strap 19 can be removed when the beach towel with built-in pillow 10 is in use.

Figure 8:
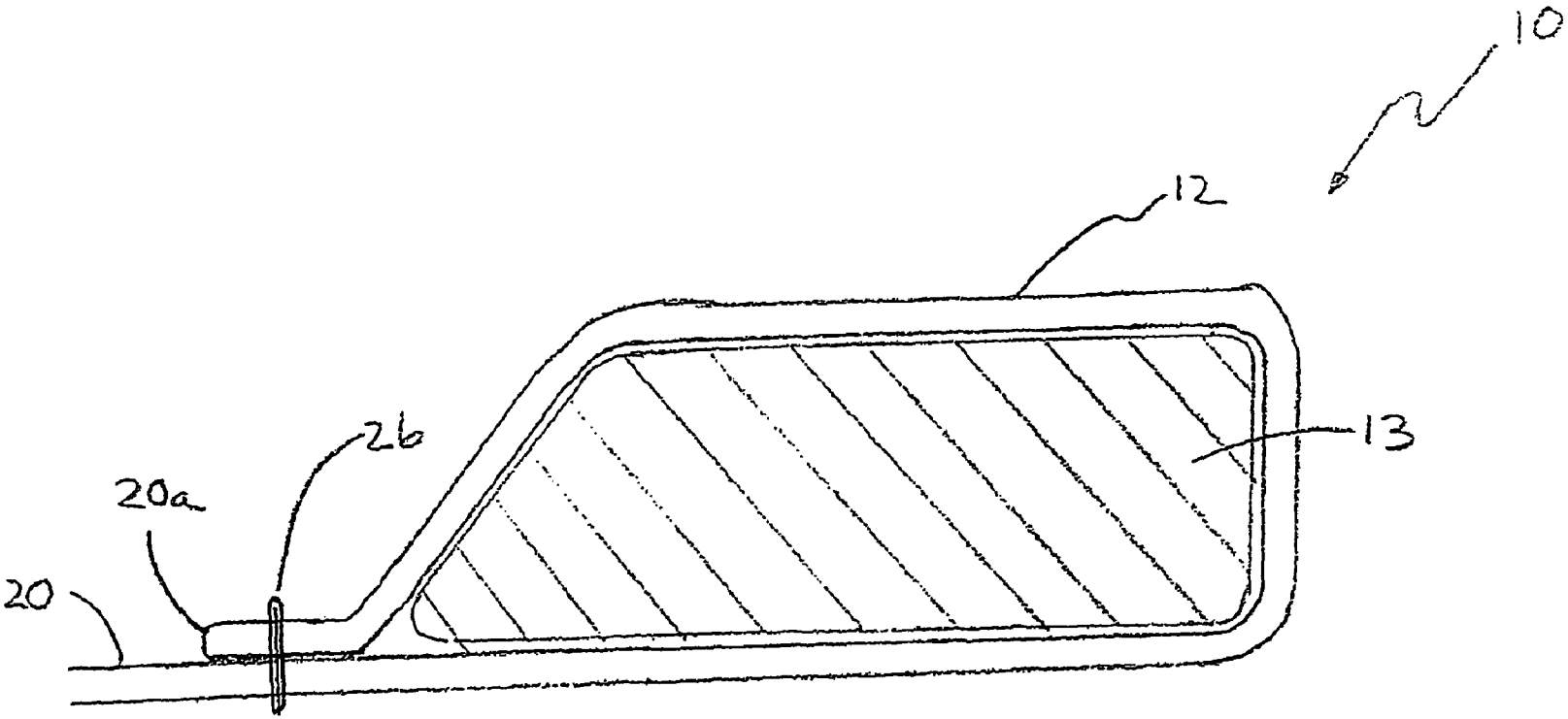
FIG. 8 is a cross-sectional view of the beach towel with built-in pillow taken along the lines 8-8 in FIG. 1.

Referring now to FIG. 8, a cross-sectional view of the pouch 12 taken along the lines 8-8 in FIG. 1 shows the orientation of the pillow 13 when it has been disposed inside of the pouch 12. A stitching 26 is preferably applied to form a seam where an end portion **20*a* of the top sheet 20 is used to form the pouch 12**.

An unexpected benefit from the invention is the pouch 12 allows for the removal of the pillow 13 so that the beach towel with built-in pillow 10 can be used as a flat ground cover when desired.

Another unexpected benefit from the invention is the inclusion of the extension sheet 22 that is able, if desired, to increase the surface area occupied by the beach towel with built-in pillow 10. This allows the area occupied by the beach towel with built-in pillow 10 to be increased longitudinally to make use of the extra available space that is located above the pouch 12.

Another benefit from the invention is the ability of the beach towel with built-in pillow 10 to be opened rapidly from a folded orientation by unfastening the towel button fasteners 16 from the towel button holes 18.

Another unexpected benefit from the invention is the inclusion of the bottom sheet 24 that is able to resist the penetration of moisture. This is ideal whenever the beach towel with built-in pillow 10 is used in locations with excess ground moisture which would saturate a presently known type of beach towel. For example, the beach towel with built-in pillow 10 can be placed on damp sand or damp soil.

Also, the use of memory foam for the pillow 13 provides head support across the width of the pouch 12. This allows more people to use the beach towel with built-in pillow 10 at the same time.

Other variations of the pillow 13 can also be used. Certain manufacturers make a type of the pillow 13 that is designed to dry faster than other more conventional designs. Accordingly, the material used for the pillow 13 can be varied, as desired. For example, for less-expensive versions of the beach towel with built-in pillow 10 less-expensive types of the pillow 13 can be included. For higher end versions of the beach towel with built-in pillow 10, more expensive types of the pillow 13, such as the use of a memory foam material are anticipated.

Other changes are also possible. For example, the preferred configuration of the top sheet top sheet 20 disposed over the water resistant bottom sheet 24 can be modified. If desired, the bottom sheet 24 can be eliminated from certain versions of the beach towel with built-in pillow 10 and only the top sheet 20 can be used. If desired, the top sheet 20 can be eliminated and only the bottom sheet 24 can be included to provide an especially compact and lightweight version of the beach towel with built-in pillow 10.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A beach towel with built-in pillow, comprising:

(a) a top sheet having a width and length wherein said top sheet is comprised of a flexible fabric;

(b) a pouch attached to an upper end of said top sheet;

(c) a pillow for placement in said pouch or removal from said pouch wherein said pillow includes a memory type of foam;

(d) a bottom sheet disposed under said top sheet, wherein said top sheet includes a film that is substantially resistant to the passage of water therethrough; and (e) an extension sheet attached to an end of said beach towel where said pillow is disposed, wherein said extension sheet is able to be folded under said top sheet and under said pillow or extended away from said top sheet and beyond said pillow;

(f) and wherein said beach towel includes an open position and a folded position for transport; and (g) a carrying strap disposed at an end of said beach towel that is opposite to where said pillow is disposed.

2. The beach towel of claim 1 wherein said carrying strap is detachably attachable with respect to said beach towel.

3. The beach towel of claim 2 wherein said carrying strap is secured at opposite ends thereof to said beach towel by the use of a pair of buttons and a pair of slots that cooperate with said pair of buttons.

4. The beach towel of claim 1 wherein said pouch is closed at three ends and open at one end and wherein a button attached to said top sheet is able to pass through a slot in an upper portion of said pouch to secure said pillow in said pouch.

5. The beach towel of claim 1 wherein said extension sheet includes said film.

6. The beach towel of claim 1 wherein said extension sheet includes said flexible fabric.

7. The beach towel of claim 1 wherein said extension sheet includes said flexible fabric on top and said film disposed under said flexible fabric.

8. The beach towel of claim 1 wherein said top sheet is bonded to said bottom sheet along a perimeter thereof to form a layered sheet.

9. The beach towel of claim 1 including a pair of towel button holes attached to a predetermined location of said beach towel and a corresponding pair of towel button fasteners attached to a second predetermined location of said beach towel, wherein said towel button fasteners cooperate with said towel button holes to secure said beach towel in a folded position for transport or storage.

10. A beach towel with built-in pillow, comprising:

(a) a top sheet having a width and length;

(b) a pouch attached to an upper end of said top sheet;

(c) a pillow for placement in said pouch or removal from said pouch;

(d) wherein said pouch is closed at three ends and open at one end and wherein a button is attached to said top sheet and is able to pass through a slot that is provided in an upper portion of said pouch to secure said pillow in said pouch; and (e) wherein said beach towel with built-in pillow includes an open position for use and a closed position for transport, and wherein when said beach towel with built-in pillow is disposed in said closed position it is secured in said closed position, and wherein when said beach towel with built-in pillow is disposed in said closed position it includes a shape and utility of a pillow;

and wherein said beach towel includes an extension sheet that is attached to an end of said beach towel where said pillow is disposed, wherein said extension sheet is able to be folded under said top sheet and under said pillow or extended away from said top sheet and beyond said pillow to provide a surface for the placement of additional items thereon.

* * * * *